US007056067B2

(12) United States Patent
Kadiu

(10) Patent No.: US 7,056,067 B2
(45) Date of Patent: Jun. 6, 2006

(54) TRENCH SHORING DEVICE

(76) Inventor: Max Kadiu, 19694 Auburn Dr., Cupertino, CA (US) 95014

( * ) Notice: Subject to any disclaimer, the term of this patent is extended or adjusted under 35 U.S.C. 154(b) by 0 days.

(21) Appl. No.: 10/678,480

(22) Filed: Oct. 3, 2003

(65) Prior Publication Data

US 2005/0074300 A1 Apr. 7, 2005

(51) Int. Cl.
*E02B 17/00* (2006.01)

(52) U.S. Cl. ..... 405/282; 405/272

(58) Field of Classification Search ..... 405/272, 405/274, 275, 276, 282, 283
See application file for complete search history.

(56) References Cited

U.S. PATENT DOCUMENTS

| | | | | |
|---|---|---|---|---|
| 1,794,704 | A | | 3/1931 | Miller |
| 1,847,842 | A | | 3/1932 | Cauley, Jr. et al. |
| 1,877,351 | A | | 9/1932 | Meem |
| 1,895,985 | A | | 1/1933 | Goldsborough |
| 1,909,980 | A | | 5/1933 | Newman |
| 2,188,077 | A | | 1/1940 | Dowd |
| 2,350,113 | A | | 5/1944 | Hurley |
| 2,482,367 | A | | 9/1949 | Ravers, Jr. |
| 2,584,015 | A | | 1/1952 | Hawes |
| 2,659,210 | A | | 11/1953 | Stengel et al. |
| 2,796,738 | A | | 6/1957 | Moore |
| 2,908,140 | A | | 10/1959 | Everson, Jr. |
| 2,956,409 | A | | 10/1960 | Wicke |
| 2,994,974 | A | | 8/1961 | Domenighetti |
| 3,159,977 | A | | 12/1964 | De Lillo |
| 3,159,978 | A | | 12/1964 | De Lillo |
| 3,186,177 | A | | 6/1965 | Kannenberg |
| 3,212,270 | A | | 10/1965 | Benintend |
| 3,224,201 | A | | 12/1965 | Brunton |
| 3,230,720 | A | | 1/1966 | Bennett |
| 3,263,430 | A | | 8/1966 | Bryan |
| 3,295,330 | A | | 1/1967 | Meshorer |
| 3,331,210 | A | | 7/1967 | Wenninger |
| 3,335,573 | A | | 8/1967 | Ward |
| 3,347,049 | A | | 10/1967 | Faltersack et al. |
| 3,362,167 | A | | 1/1968 | Ward |
| 3,379,018 | A | | 4/1968 | Frentzel et al. |
| 3,393,521 | A | | 7/1968 | Cammisa |
| 3,404,533 | A | | 10/1968 | Brunton |
| 3,470,699 | A | | 10/1969 | Cox |
| 3,530,679 | A | * | 9/1970 | Krings ..... 405/282 |
| 3,584,465 | A | | 6/1971 | Holl |
| 3,593,528 | A | | 7/1971 | Pavese |
| 3,621,660 | A | * | 11/1971 | Krings ..... 405/282 |

(Continued)

FOREIGN PATENT DOCUMENTS

| | | |
|---|---|---|
| DE | 32 43 120 | 5/1984 |

(Continued)

*Primary Examiner*—Frederick L. Lagman

(57) ABSTRACT

This invention discloses a device for shoring open excavations including a pair of shoring panels held vertically apart and parallel to each other against sidewalls of excavation by a pair of strutting assemblies. Each shoring panel having laterally on either end a vertical guide of circular cross section and lengthwise two identical cutting edges of triangular cross section, which are inversely arranged one on the top and the other at the bottom of panel and reverse relative to sidewall of excavation as well. Each strutting assembly has a pair of vertical struts held against each other by at least one horizontal strut that is fastened by pin or bolts onto vertical supports. Each vertical strut is provided with a circular guide channel encompassing the guide of shoring panel and interlocking with it, so that shoring panels slide independently from each other, while the strutting assembly can adjust different pipe culverts.

7 Claims, 10 Drawing Sheets

U.S. PATENT DOCUMENTS

| | | | | | |
|---|---|---|---|---|---|
| 3,668,874 | A | | 6/1972 | Krings | |
| 3,710,578 | A | | 1/1973 | Inoue | |
| 3,727,413 | A | | 4/1973 | Christen | |
| 3,729,938 | A | | 5/1973 | Morrice | |
| 3,766,740 | A | | 10/1973 | Teegen | |
| 3,782,125 | A | | 1/1974 | Holl | |
| 3,782,126 | A | | 1/1974 | Pavese | |
| 3,788,086 | A | | 1/1974 | West, Jr. | |
| 3,791,151 | A | | 2/1974 | Plank | |
| 3,831,384 | A | | 8/1974 | Kempster | |
| 3,851,856 | A | | 12/1974 | Berg | |
| 3,858,399 | A | | 1/1975 | Krings | |
| 3,864,921 | A | | 2/1975 | Marx et al. | |
| 3,869,867 | A | | 3/1975 | Krings | |
| 3,881,679 | A | | 5/1975 | Krings | |
| 3,910,053 | A | * | 10/1975 | Krings | 405/282 |
| 3,910,054 | A | | 10/1975 | Krings | |
| 3,937,026 | A | | 2/1976 | Krings | |
| 3,950,952 | A | | 4/1976 | Krings | |
| 3,967,454 | A | | 7/1976 | Barnes | |
| 3,969,852 | A | | 7/1976 | Krings | |
| 3,995,565 | A | | 12/1976 | Kersey | |
| 3,999,393 | A | | 12/1976 | Krings | |
| 4,019,328 | A | | 4/1977 | Koehl | |
| 4,048,778 | A | | 9/1977 | Krings | |
| 4,054,033 | A | | 10/1977 | Pillosio | |
| 4,056,940 | A | | 11/1977 | Fisher | |
| 4,059,964 | A | | 11/1977 | Pavese | |
| 4,090,365 | A | | 5/1978 | Nieber | |
| 4,099,386 | A | | 7/1978 | Sagasta | |
| 4,114,383 | A | | 9/1978 | Nieber | |
| 4,139,324 | A | | 2/1979 | Krings | |
| 4,145,891 | A | | 3/1979 | Krings | |
| 4,154,062 | A | | 5/1979 | Koehl | |
| 4,159,585 | A | | 7/1979 | Brown | |
| 4,168,053 | A | | 9/1979 | Boenninghaus | |
| 4,188,159 | A | | 2/1980 | Clarke et al. | |
| 4,199,278 | A | | 4/1980 | Koehl | |
| 4,202,649 | A | | 5/1980 | Cook et al. | |
| 4,247,997 | A | | 2/1981 | Paurat et al. | |
| 4,259,028 | A | | 3/1981 | Cook | |
| 4,259,029 | A | | 3/1981 | Koehl | |
| 4,259,030 | A | | 3/1981 | Montoya | |
| 4,274,763 | A | | 6/1981 | Krings | |
| 4,279,548 | A | | 7/1981 | Ramey | |
| 4,310,267 | A | | 1/1982 | Davis | |
| 4,345,857 | A | | 8/1982 | Krings | |
| 4,370,079 | A | | 1/1983 | Pizzirani | |
| 4,372,709 | A | | 2/1983 | Krings | |
| 4,376,599 | A | | 3/1983 | Krings | |
| 4,421,440 | A | | 12/1983 | Scheepers | |
| 4,453,861 | A | | 6/1984 | Bretz et al. | |
| 4,453,863 | A | | 6/1984 | Sutton et al. | |
| 4,472,090 | A | | 9/1984 | Krings | |
| 4,484,842 | A | | 11/1984 | Engelhaupt | |
| 4,487,530 | A | | 12/1984 | Morrice | |
| 4,501,517 | A | | 2/1985 | Seyle | |
| 4,521,137 | A | | 6/1985 | Brecht | |
| 4,547,097 | A | | 10/1985 | Bell | |
| 4,548,528 | A | | 10/1985 | Bell | |
| 4,591,298 | A | | 5/1986 | Fukumori et al. | |
| 4,657,442 | A | * | 4/1987 | Krings | 405/282 |
| 4,659,261 | A | | 4/1987 | Chiaves | |
| 4,682,914 | A | | 7/1987 | Aihara et al. | |
| 4,685,837 | A | | 8/1987 | Cicanese | |
| 4,695,204 | A | | 9/1987 | Bell | |
| 4,696,607 | A | | 9/1987 | Ressi di Cervia | |
| 4,752,157 | A | | 6/1988 | Ischebeck et al. | |
| 4,787,781 | A | | 11/1988 | Bradberry | |
| 4,843,780 | A | | 7/1989 | Krings | |
| 4,874,271 | A | | 10/1989 | Arnold | |
| 4,886,399 | A | | 12/1989 | Pidgeon | |
| 4,900,197 | A | | 2/1990 | Ward | |
| 4,960,258 | A | | 10/1990 | Stocker et al. | |
| 4,993,877 | A | | 2/1991 | Beamer | |
| 4,993,878 | A | | 2/1991 | Beamer | |
| 4,993,880 | A | | 2/1991 | Collins | |
| 5,000,621 | A | | 3/1991 | Beamer | |
| 5,011,331 | A | | 4/1991 | Clavarino | |
| 5,044,831 | A | | 9/1991 | Myles et al. | |
| 5,052,862 | A | | 10/1991 | Uffmann | |
| 5,073,066 | A | | 12/1991 | Richland | |
| 5,080,533 | A | | 1/1992 | Cooper | |
| 5,096,334 | A | | 3/1992 | Plank | |
| 5,123,785 | A | | 6/1992 | Orfei | |
| 5,129,763 | A | | 7/1992 | Deusenbery | |
| 5,154,541 | A | | 10/1992 | Boren et al. | |
| 5,158,398 | A | | 10/1992 | Pinho | |
| 5,167,468 | A | | 12/1992 | Crafton | |
| 5,174,685 | A | | 12/1992 | Buchanan | |
| 5,180,256 | A | | 1/1993 | Krings | |
| 5,183,316 | A | | 2/1993 | Ottestad | |
| 5,188,332 | A | | 2/1993 | Callas | |
| 5,190,412 | A | | 3/1993 | Salvatore | |
| 5,195,849 | A | | 3/1993 | Stapleton | |
| 5,197,829 | A | | 3/1993 | Krings | |
| 5,199,824 | A | | 4/1993 | Smith et al. | |
| 5,209,606 | A | | 5/1993 | Plank | |
| 5,232,312 | A | | 8/1993 | Jennings et al. | |
| 5,232,313 | A | | 8/1993 | Jennings et al. | |
| 5,259,705 | A | | 11/1993 | Breaux et al. | |
| 5,277,522 | A | | 1/1994 | Pertz | |
| 5,281,051 | A | | 1/1994 | Stegall | |
| 5,290,129 | A | | 3/1994 | Rody et al. | |
| 5,302,054 | A | | 4/1994 | Winkler et al. | |
| 5,305,568 | A | | 4/1994 | Beckerman | |
| 5,306,103 | A | | 4/1994 | Spencer | |
| 5,310,289 | A | * | 5/1994 | Hess | 405/282 |
| 5,310,290 | A | | 5/1994 | Spencer | |
| 5,320,440 | A | | 6/1994 | Papadopoulos | |
| 5,336,023 | A | | 8/1994 | Burdine | |
| 5,344,258 | A | | 9/1994 | Papadopoulos | |
| 5,348,421 | A | | 9/1994 | Stegall | |
| 5,393,171 | A | | 2/1995 | Stegall | |
| 5,399,057 | A | | 3/1995 | Cunic | |
| 5,401,122 | A | | 3/1995 | Pate, Jr. | |
| 5,499,890 | A | | 3/1996 | Kishi | |
| 5,503,504 | A | * | 4/1996 | Hess et al. | 405/282 |
| 5,513,555 | A | | 5/1996 | Plank et al. | |
| 5,516,238 | A | | 5/1996 | Beury | |
| 5,522,678 | A | | 6/1996 | Marshall et al. | |
| 5,527,137 | A | | 6/1996 | Spencer | |
| 5,533,838 | A | | 7/1996 | Kundel | |
| 5,595,459 | A | | 1/1997 | LoMonaco | |
| 5,611,643 | A | | 3/1997 | Tallard | |
| 5,624,206 | A | | 4/1997 | Cohen et al. | |
| 5,669,738 | A | | 9/1997 | Kundel | |
| 5,720,580 | A | | 2/1998 | Ryhsen | |
| 5,725,330 | A | | 3/1998 | Krings | |
| 5,735,642 | A | | 4/1998 | Barringer | |
| 5,741,091 | A | | 4/1998 | St. George et al. | |
| 5,829,921 | A | | 11/1998 | Krings | |
| 5,839,707 | A | | 11/1998 | Barringer | |
| 5,865,567 | A | | 2/1999 | Wilkinson | |
| 5,868,060 | A | | 2/1999 | Plank et al. | |
| 5,868,526 | A | | 2/1999 | Caulder | |
| 5,876,153 | A | | 3/1999 | Krings | |
| 5,885,033 | A | | 3/1999 | Krings | |
| 5,902,075 | A | * | 5/1999 | Krings | 405/282 |
| 5,931,607 | A | | 8/1999 | Hess | |
| 5,931,608 | A | | 8/1999 | Wilkinson | |
| 6,017,170 | A | | 1/2000 | Michalo | |
| 6,039,522 | A | | 3/2000 | Cardona | |
| 6,155,750 | A | | 12/2000 | Wu et al. | |

| | | | | |
|---|---|---|---|---|
| 6,164,874 | A * | 12/2000 | May | 405/283 |
| 6,164,875 | A | 12/2000 | Wu et al. | |
| 6,224,296 | B1 * | 5/2001 | Fukumori | 405/282 |
| 6,267,538 | B1 | 7/2001 | Caldwell | |
| 6,416,259 | B1 | 7/2002 | Meyer | |
| 6,443,665 | B1 | 9/2002 | Kundel, Sr. | |
| 6,474,911 | B1 | 11/2002 | Krings | |
| 2004/0170478 | A1 * | 9/2004 | Kadiu | 405/282 |

FOREIGN PATENT DOCUMENTS

| | | |
|---|---|---|
| DE | 33 66 982 | 11/1986 |
| DE | 34 72 126 | 7/1988 |
| DE | 37 11 408 | 10/1988 |
| DE | 38 09 708 | 10/1990 |
| DE | 90 123 01 | 1/1991 |
| DE | 43 16 824 | 11/1994 |
| DE | 59 400 725 | 10/1996 |
| DE | 296 16 986 | 1/1997 |
| DE | 59 306 266 | 5/1997 |
| DE | 297 03 190 | 5/1997 |
| DE | 196 01 480 | 7/1997 |
| DE | 196 21 826 | 12/1997 |
| DE | 197 53 561 | 6/1999 |
| DE | 199 03 520 | 9/1999 |
| DE | 199 44 116 | 7/2000 |
| DE | 299 18 383 | 10/2000 |
| DE | 200 16 955 | 3/2001 |
| DE | 201 09 836 | 10/2001 |
| DE | 201 16 752 | 4/2002 |
| DE | 100 63 039 | 6/2002 |
| DE | 29 924 252 | 10/2002 |
| EP | 0 039 960 | 11/1981 |
| EP | 0 046 553 | 3/1982 |
| EP | 0 100 083 | 2/1984 |
| EP | 0 144 007 | 6/1985 |
| EP | 0 628 663 | 12/1994 |
| EP | 0 712 962 | 5/1996 |
| EP | 0 810 328 | 12/1997 |
| EP | 0 921 235 | 6/1999 |
| EP | 1 193 350 | 4/2002 |
| GB | 1 454 022 | 10/1976 |
| WO | WO 84/00572 | 2/1984 |

* cited by examiner

TRENCH SHORING DEVICE

TECHNICAL FIELD

This invention relates to shoring devices for trenches and other open excavations employed in construction industry.

BACKGROUND OF THE INVENTION

This invention relates to devices for shoring open excavations. The device includes a pair of shoring panels held vertically apart and parallel to each other against sidewalls of excavation by a pair of strutting assemblies. Each shoring panel has laterally, on either end a vertical guide, and lengthwise two identical cutting edges of triangular cross section. The cutting edges are inversely arranged one on the top and the other at the bottom of the panel and opposite relative to sidewall of excavation. The panel is therefore versatile by mean that it could be used all ways, the inside out or upside down. Each strutting assembly has a pair of vertical struts held against each other by at least one horizontal strut that is fastened by pin or bolts onto vertical struts. Each vertical strut is provided lengthwise with a panel guide cooperatively engaging the guide of shoring panel and interlocking with it, so that shoring panels slide independently from each other, while the strutting assembly can adjust different pipe culverts. In another perspective, the panel is versatile in the sense that it could be used as a traditional trench shield, as a sliding system in combination with the strutting assembly and/or with any other sliding shoring device provided with panel guide that fits the guide of shoring panel.

The components of this shoring device are assembled together during first stage of excavation, up to 4 ft. deep, and create altogether a two side wall box. Afterward, the panels are pushed down one at time and independently to each other as excavation progresses. If depth of excavation is superior to height of the panel, another such shoring device is stacked above the previous one. The removal from the ground of such shoring device is easier consisting of simply removing the strutting assemblies first and the panels afterward.

There are many shoring devices used for securing the walls of open excavations and the working space inside it. One type of such shoring devices, commonly called trench shields, have usually two panels held by individual spreaders pinned or bolted onto the extremities of each panel via flanges or fixed connectors. The panels are usually provided with a cutting edge at the bottom part to facilitate penetration into the ground. The majority of these devices are rigid in a sense that they do not allow relative movement between spreaders and panels and most of the time their installation is achieved after excavation.

Other types of shoring devices having panels and sliding spreaders are disclosed in U.S. Pat. No. 3,530,679 (Krings), and U.S. Pat. No. 5,503,504 (Hess et al.). The panels used by these devices comprise support columns or special legs fastened temporarily or permanently onto the side of the panel, which is inner relative to interior of the trench. Individual spreaders or a strutting frame slide formlockingly between respective opposite columns of a pair of panels. For any of these devices, the panel is designated to work with a defined type of spreader system and in a very unique way. The bottom and upper part of the panel are not technically substitutable, likewise the side of the panel which is inner relative to interior of the trench can not be outer and vice—versa. The columns or legs fastened onto inner side of the panel increase drastically the volume in transportation or the storage of such panels. A very important limiting aspect of mentioned devices is the fact that their panels are not, or could not be used with other existing types of shoring devices requesting additional inventory in panel. Other difficulties related to staking of two or more of these devices, have revealed limitations regarding successive alignment of the columns and/or spreader system.

Another type of shoring device, commonly called slide rail shoring system, has a plurality of pairs of opposite rails or supporting columns spaced along the trench so that each pair is supported by a strutting frame which slides within opposite rail supports. Each rail support is provided on either side with guide channels where edges of large shoring panels slide within so that every two adjacent rails are connected with at least one shoring panel. This type of shoring device is currently used in the construction projects despite aversion in costs, weight and structural damages during utilization.

Knowing shoring device that has panels sliding vertically within excavation without using vertical support columns is disclosed in U.S. Pat. No. 6,224,296 (Fukumori). This device uses two pairs of large shoring panels. The first pair of panels, which shores the upper part of trench pressing against the excavation walls, is fixed at ground level. The second pair of panels slides within first pair shoring thereby the lower part of excavation. Both pairs of panels are connected and use sets of rigging to control the installation and removal of this device. Such device perform poorly in deep excavation and requires accurate installation regarding the space between first pair of panels their parallelism, etc. The removal of the panel is also associated with damages of guiding pair of panels.

U.S. Pat. Nos. 3,621,660, 3,910,053 and 4,657,442 (Krings), U.S. Pat. No. 5,310,289 (Hess), U.S. Pat. No. 6,164,874 (May) disclose various slide rail shoring system, all of them including multiple pairs of columns, spreader systems and large shoring panels. The support columns and the spreader systems used with these shoring systems are very heavy and are often hammered to push it down which often results with strong damages and heavy costs in maintenance.

IN BRIEF SUMMARY OF THE INVENTION

Substantially, the intent of present invention is to provide a shoring device of type described above that allows shoring panels to slide independently to each other so that the device could be lowered progressively as excavation progresses while supporting the excavation walls.

Pursuing this objective and others that will be explicit subsequently, one important aspect of the present invention resides on design of a strutting assembly that slides vertically formolckingly along lateral guides of shoring panels accommodating different pipe culverts and securing the soils surrounding the excavation while shielding the working space inside it.

IN DETAILED DESCRIPTION OF INVENTION

Another aspect of this invention is the introduction of a shoring panel having two identical cutting edges fixed lengthwise one on the top and the other at the bottom of the panel. Thus, each panel could be used upside down or inside out according to the need of the user. Yet stacking of such devices over each other is considerably simplified as the cutting edge of the upper panel is supported, vertically and horizontally, by the cutting edge of lower panel eliminating thereby the need of using heavy arches to support the load on upper panels. Moreover, a major aspect coming with this invention relates the removal of such shoring devices when stacked over each other. As the contact between bottom and upper panel is made along the inclined plan defined by the cutting edges, it is possible to remove the bottom panel first and the upper panel afterward by just lifting preliminary the strutting assembly on the upper panels.

The new features considered as characteristic for the invention are set forth in the appended claims. Other advantages of the invention will be appreciated in view of the following description and drawings.

BRIEF DESCRIPTION OF THE SEVERAL VIEWS OF THE DRAWINGS

FIG. 1 is a sectional view of a trench showing two shoring panels and a strutting assembly in between.

DETAILED DESCRIPTION OF THE INVENTION

Figure 1:
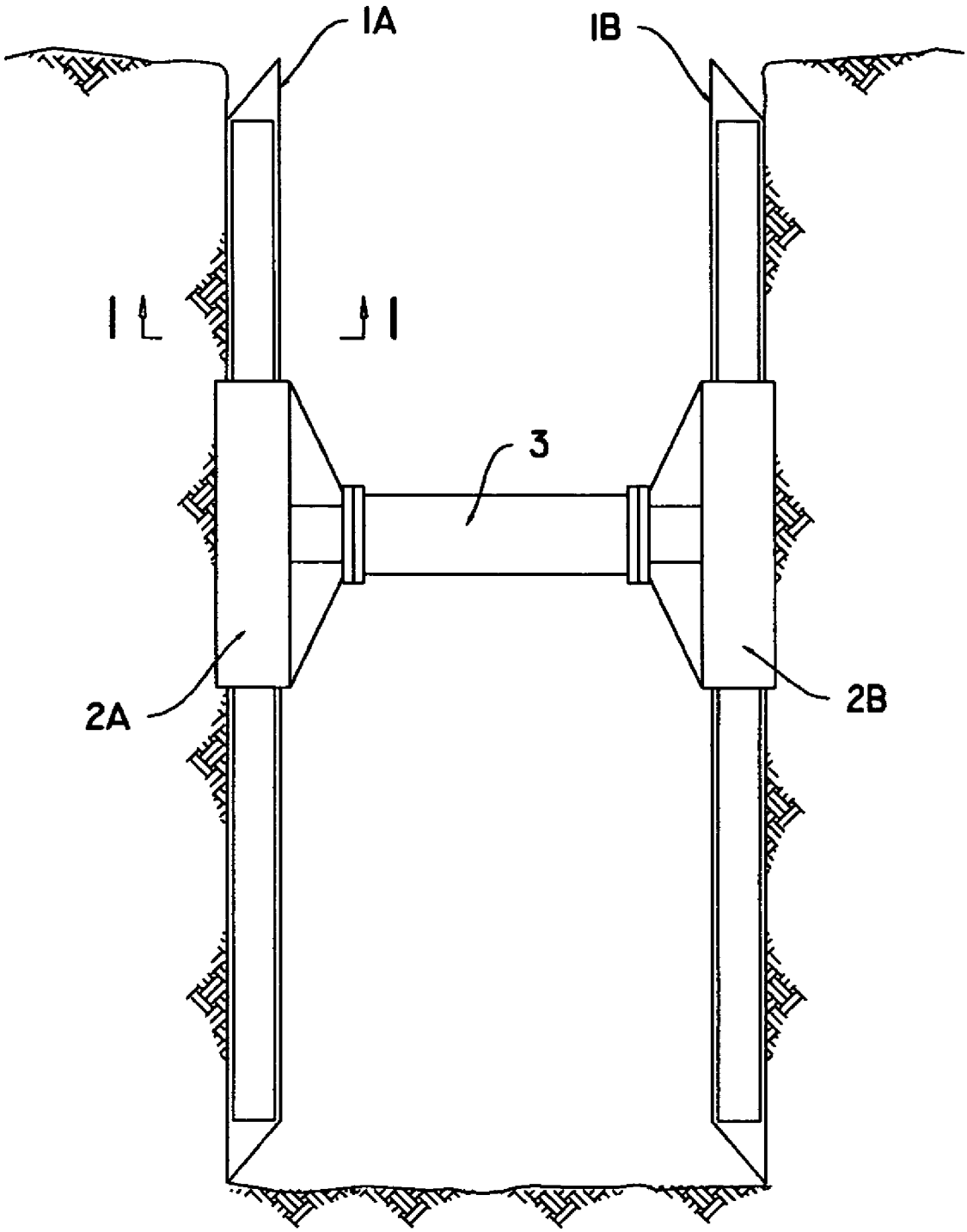

Referring to the drawings where like numerals indicate like elements, various embodiments incorporating the new features of the present invention are illustrated. The shoring device has one pair of panels and one pair of strutting assemblies. FIG. 1 illustrates a pair of panels 1A and 1B, which are located symmetrically on either side of the trench held by the strutting assembly comprising a pair of vertical struts 2A, 2B and the horizontal strut 3.

Figure 2:
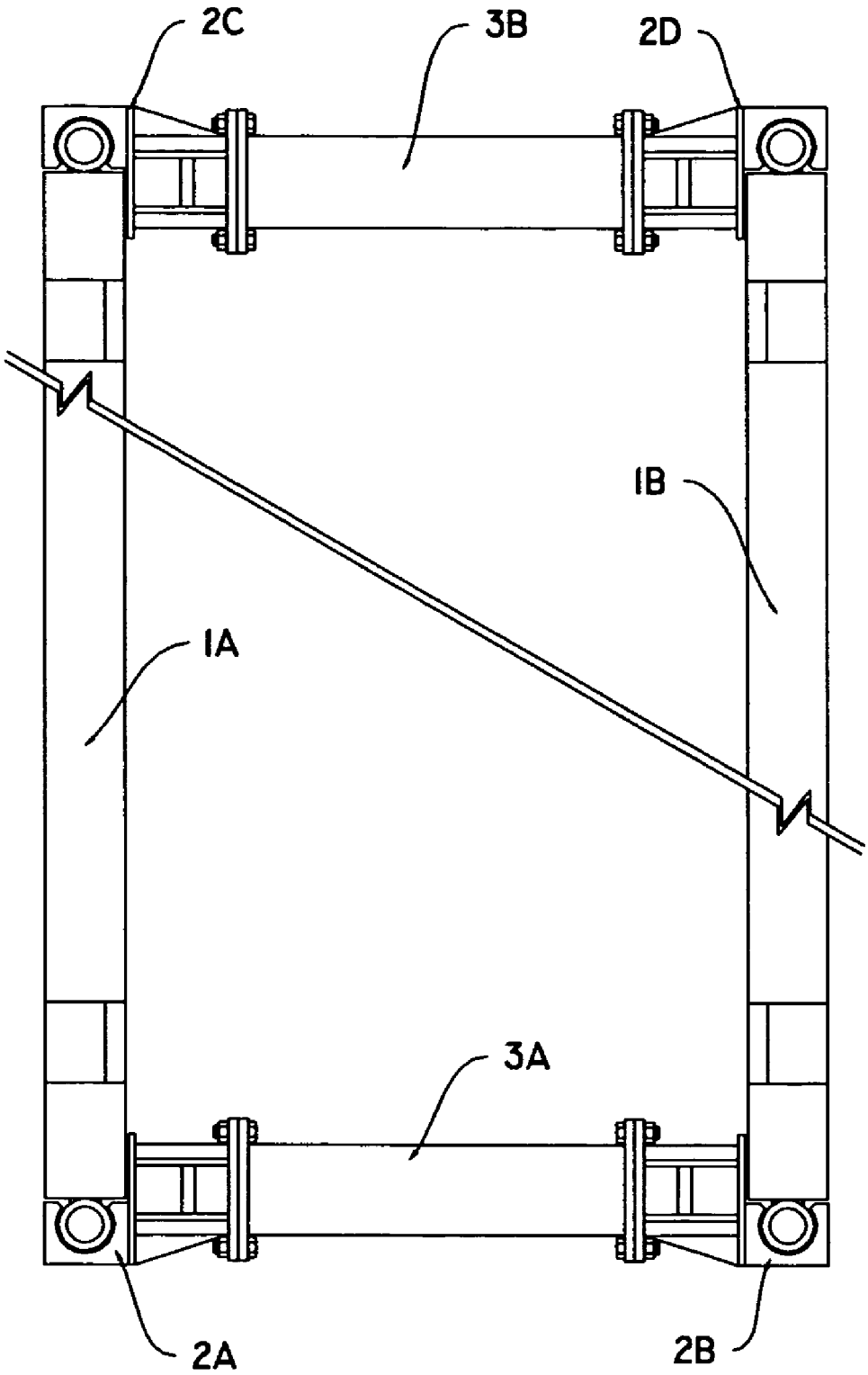
FIG. 2 is a top view of the shoring device showing the pair of panels and the pairs of strutting assembly as installed in a trench.

The figure FIG. 2 shows a top view of the arrangement of the panels 1A and 1B, one first strutting assembly consisting of vertical struts 2A, 2B and the horizontal strut 3A, and a second strutting assembly comprising the vertical struts 2C, 2D and the horizontal strut 3B.

Figure 3:
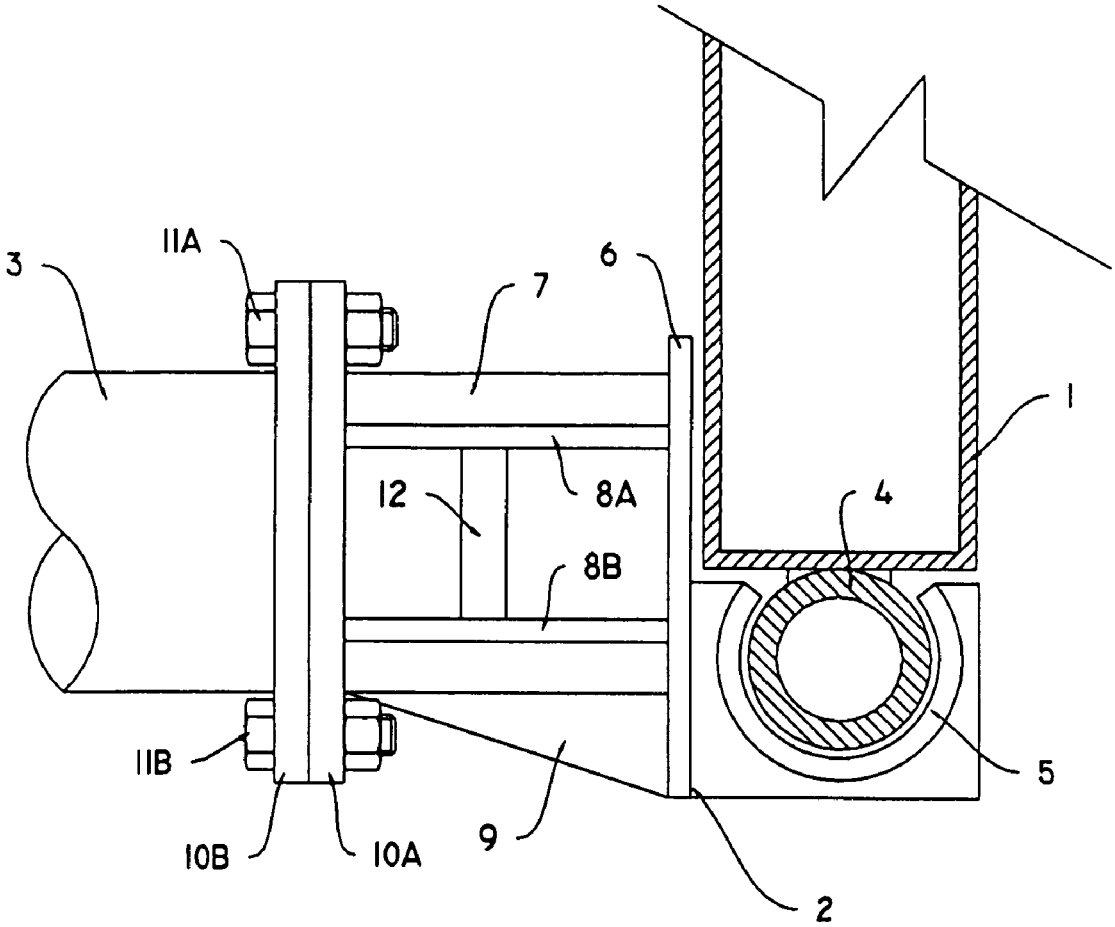
FIG. 3 is a sectional view taken along the line I—I of the FIG. 1, showing the cross section of the guide edge of the panel and its receiving guide channel in the strutting assembly.

As shown in the FIG. 3, the panel 1 has laterally at extremity a guide 4 of tubular cross section. The vertical strut 2 consists of a panel guide 5 encompassing the guide 4 of the panel 1, the support flange 6, the horizontal tube 7, the contact flange 10A, the vertical reinforcement pieces 8A, 8B, the horizontal stiffener 9 and a lifting plate 12 provided with a hole, not shown. The horizontal strut 3 is fastened by bolts 11A and 11B via flange 10B onto the vertical strut 2. The panel guide 5 interlock horizontally with the guide 4 while allowing the vertical movement of panel 1 relative to vertical strut 2.

Figure 4:
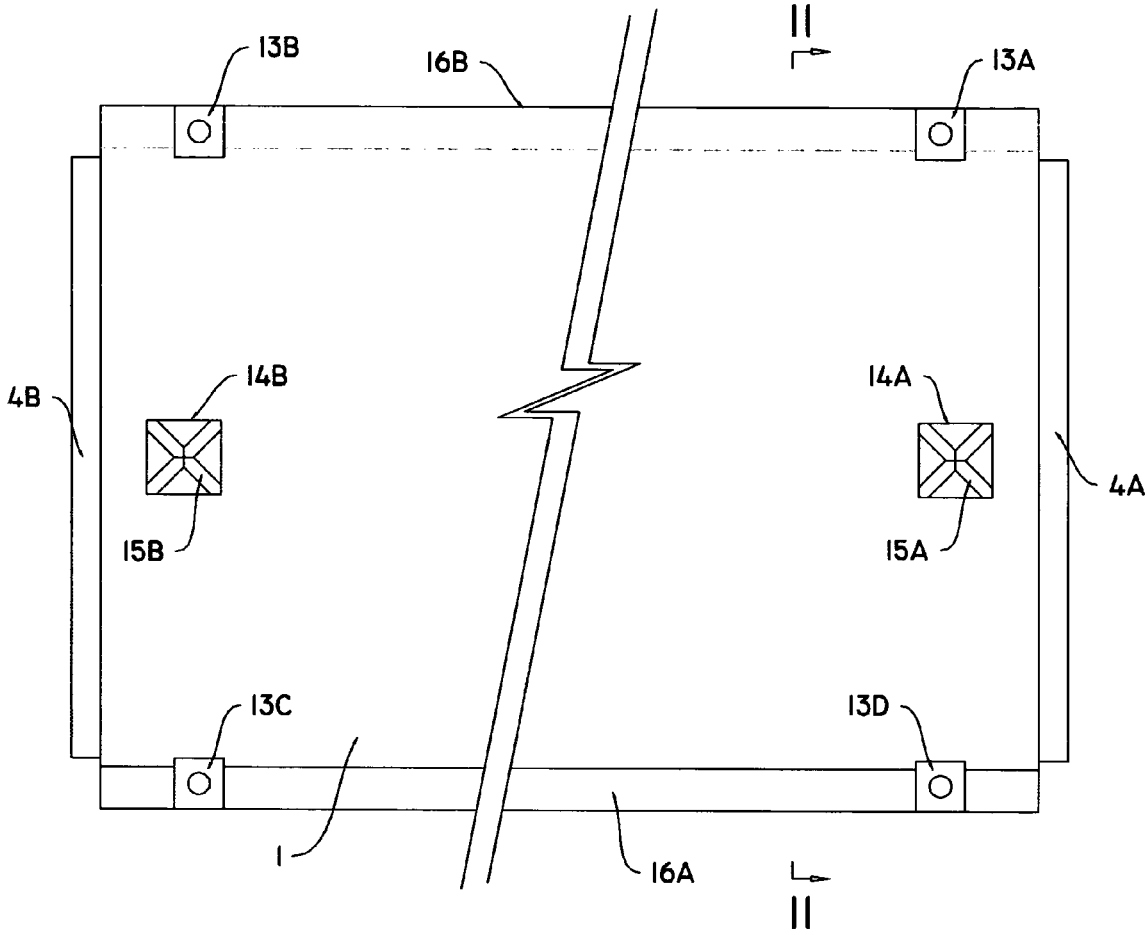
FIG. 4 is a front view of a panel showing its basic features.

FIG. 4 shows the panels 1 having lateral guides 4A and 4B along either end, the cutting edges 16A and 16B respectively at the bottom and along the top, and the lifting plates 13A, 13B, 13C, 13D. Two extra lifting and/or pulling cross bars 15A and 15B are provided within square holes 14A and 14B.

Figure 5:
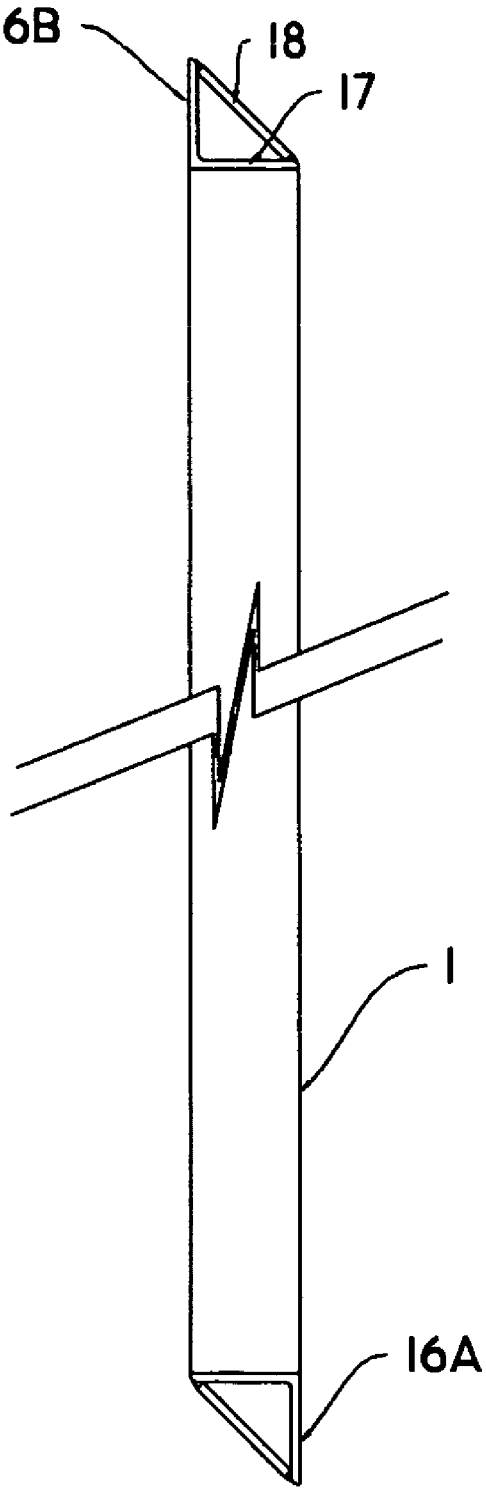
FIG. 5 is a sectional view taken along the line II—II of the FIG. 4, showing the upper and lower cutting edges of the panel.

As shown in FIG. 5, the cutting edges 16A and 16B are orientated reverse relative to each other and relative to the plan of panel 1 itself so that when the panel 1 is rotated with 180 degrees around an axis perpendicular to the plan of FIG. 5 the cutting edges 16A and 16B switch position. A simple way of forming the cutting edges is by welding together an angle 18 with a flat bar 17.

Figure 6:
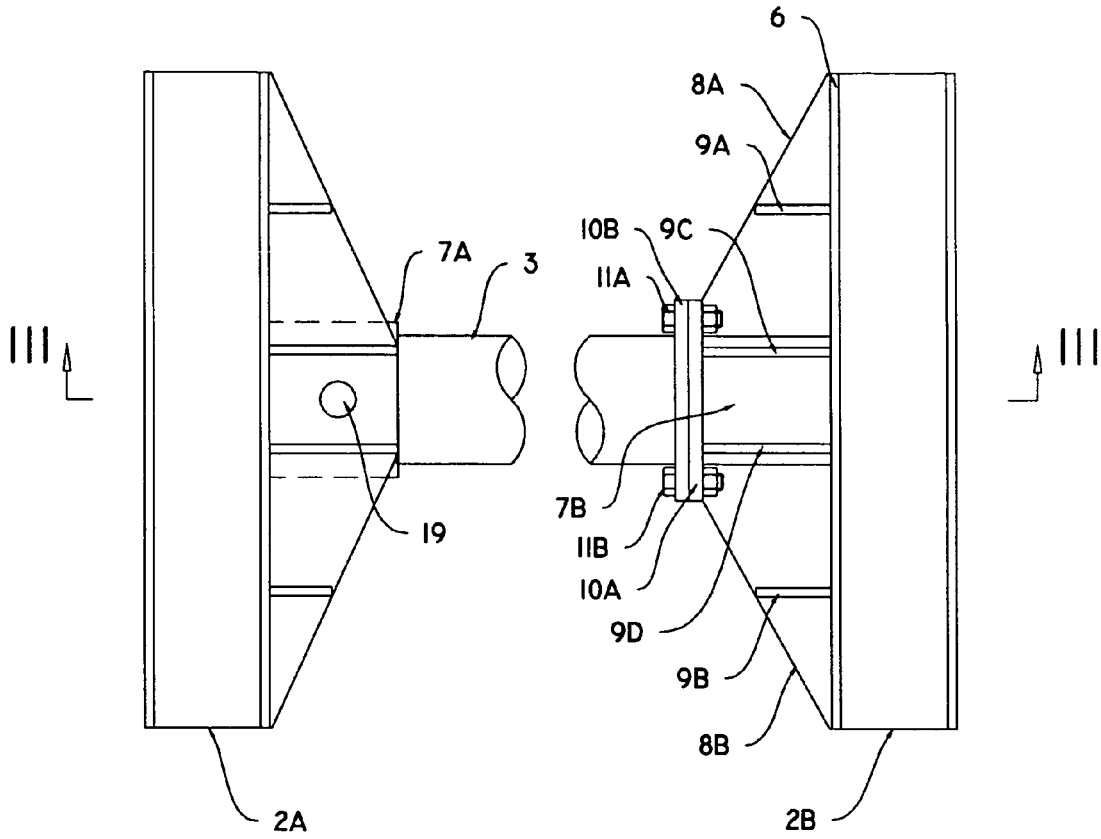
FIG. 6 is a front view of strutting assembly having one horizontal strut.

FIG. 6 illustrates more in details the strutting assembly consisting of vertical struts 2A, 2B and the horizontal strut 3. The tubes 7A and 7B, which are used as supports for the connection of horizontal strut 3 onto vertical struts 2A, 2B, could be of round or rectangular cross section. The tube 7A is provided with a hole 19 representing the case of a pin connection with the horizontal strut 3, while the tube 7B is bolted onto strut 3 via flanges 10A and 10B by using bolts 11A and 11B. A view of vertical reinforcement pieces 8A, 8B and stiffeners 9A, 9B, 9C and 9D is also illustrated for the vertical strut 2B.

Figure 7:
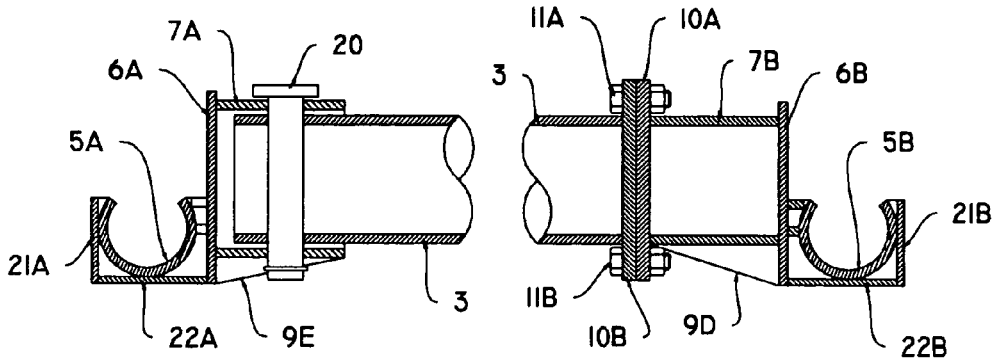
FIG. 7 is a sectional view taken along the line III—III of the FIG. 6, showing the structure of the strutting assembly.

As shown in FIG. 7 the panel guide 5A and 5B are respectively welded onto the support flanges 6A and 6B via flat bars 21A, 21B and 22A, 22B. The pin 20 represent a connection of choice between horizontal strut 3 and tube 7A.

Figure 8:
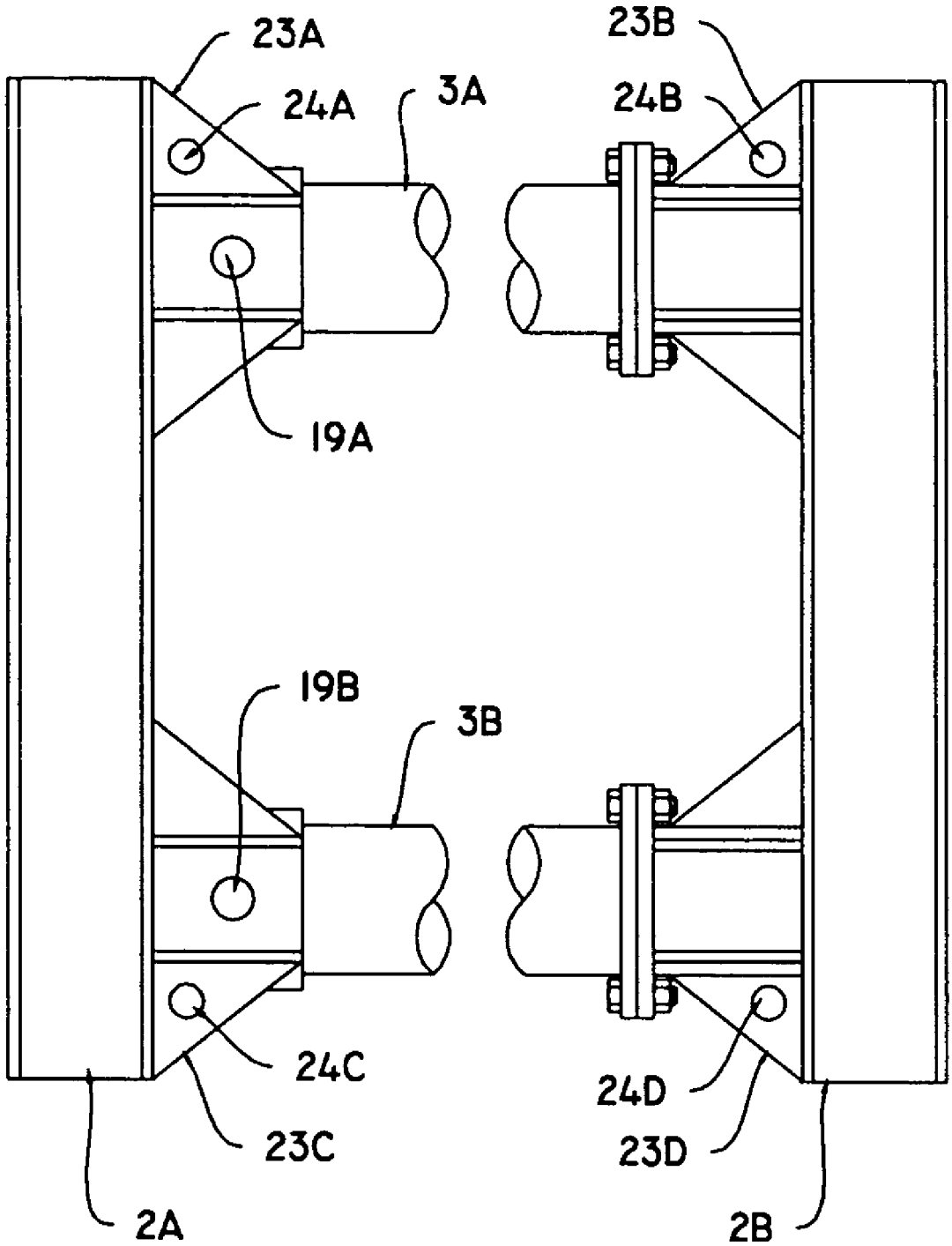
FIG. 8 is a front view of strutting assembly provided with two horizontal struts.

FIG. 8 illustrates a strutting assembly consisting of two vertical struts 2A, 2B and two horizontal struts 3A, 3B. The vertical struts are provided with lifting plates 23A, 23B, 23C and 23D with holes respectively noted 24A, 24B, 24C and 24D.

Figure 9:
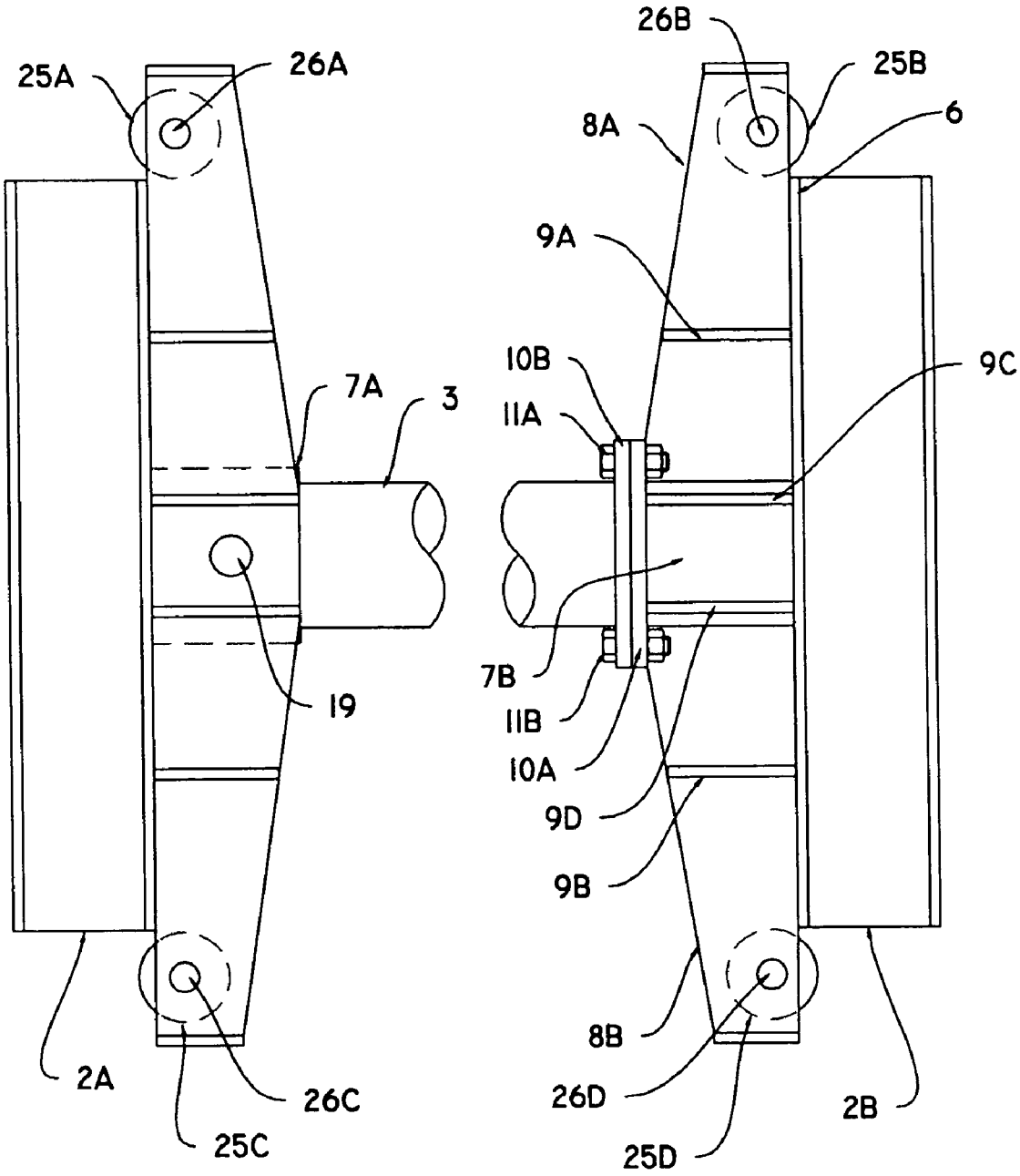
FIG. 9 is a front view of strutting assembly provided with rollers.

As shown in FIG. 9, the vertical struts 2A and 2B are provided with rollers 25A, 25B, 25C and 25D rotating respectively around the axles 26A, 26B, 26C and 26D, so that the strutting assembly could slide easier.

Figure 10:
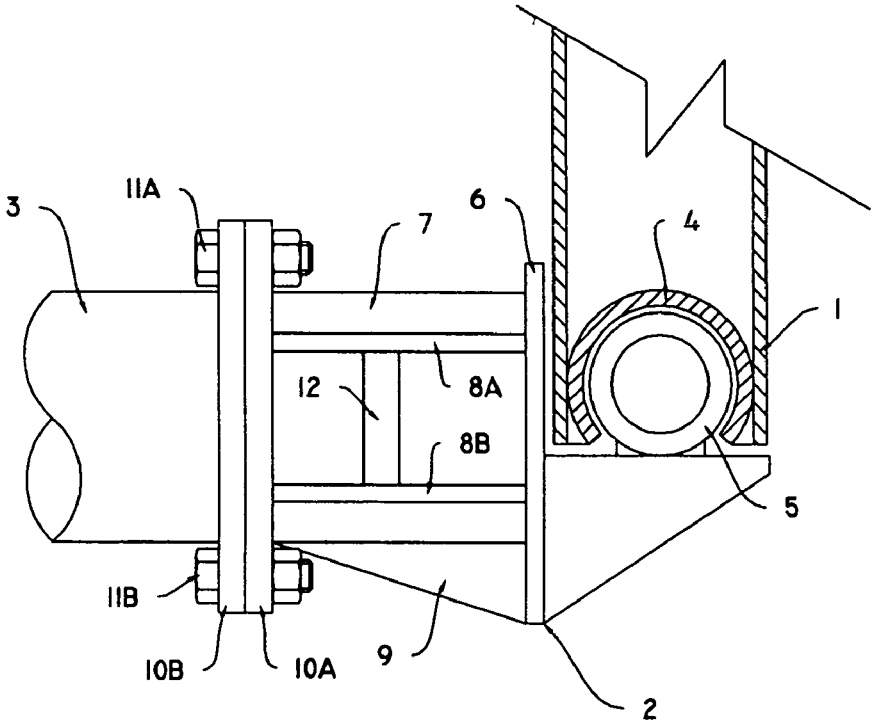
FIG. 10 is a sectional view taken along the line I—I of the FIG. 1, showing a panel receiving a guide edge embedded in the strutting assembly.

FIG. 10 shows a cross section of another type of interlocking between panel 1 and the vertical strut 2. In this case, the panel is provided at extremity with a circular guide channel 4 while the vertical strut 2 has a tubular panel guide 5 sliding within.

Figure 11:
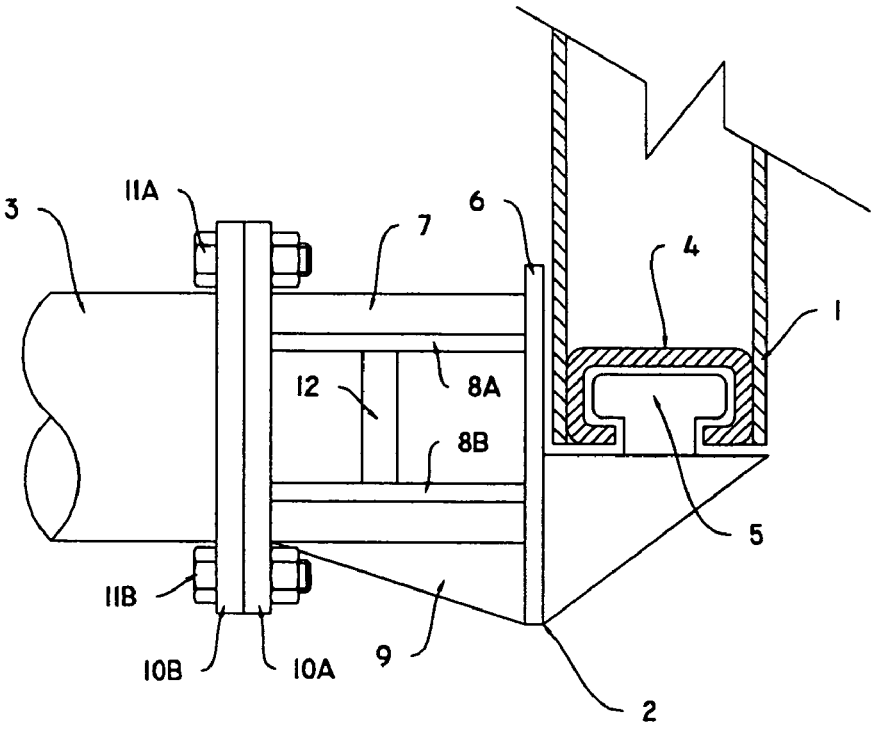
FIG. 11 is a sectional view taken along the line I—I of the FIG. 1, showing a panel receiving a guide edge of rectangular cross section embedded in the strutting assembly.
Figure 12:
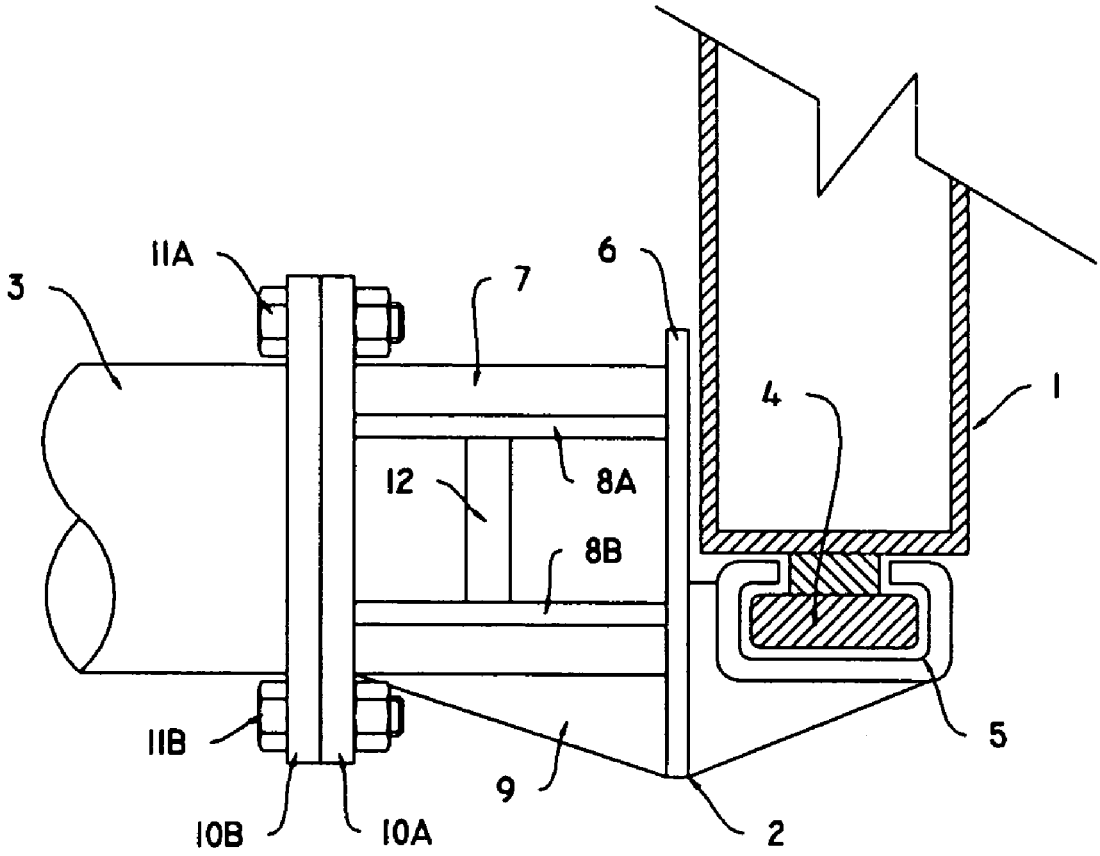
FIG. 12 is a sectional view taken along the line I—I of the FIG. 1, showing a panel having a guide edge of rectangular cross and its receiving guide channel in the strutting assembly.

As showing in the FIG. 11, another type of sliding connection between vertical strut 2 and the panel 1 could be achieved by using the 'C' type guide channel 4 and the 'T' type guide edge 5. Yet, the reverse is showing in FIG. 12, where the panel 1 is provided with a 'T' type guide edge, while the vertical strut 2 has a 'C' type guide channel 5.

While the invention is illustrated and described in a trenching application it is not intended to be limited to the details shown since some various modifications or structural changes would not change the basic structure and principle of present invention.

I claim:

1. A shoring device for trenches and ditches comprising a pair of shoring panels held vertically apart against sidewalls of a trench by a pair of strutting assemblies wherein:

each said shoring panel having laterally on either end a guide built onto and along the side denoting the thickness of said panel;

each said strutting assembly having a pair of vertical struts held oppositely apart by at least one horizontal strut, each said vertical strut being fastened rigidly on either end of said horizontal strut by mean that said horizontal strut does not pivot nor can displace vertically relative to said vertical strut, each said vertical strut being provided with a panel guide to partially engage and cooperatively interlock said guide of said panel so that said panel slides vertically relative to said vertical strut.

2. A shoring device as set forth in the claim 1, wherein said vertical struts of said strutting assembly are provided on either end with at least one roller.

3. A shoring device as set forth in the claim 1, wherein said panel having lengthwise at the bottom a cutting edge, said cutting edge having a cross section shaping a right triangle.

4. A shoring device a set forth in the claim 3, wherein each said panel has lengthwise on the top a second said cutting edge arranged oppositely to said cutting edge provided at the bottom of said panel by mean that said cutting edges are arranged on opposite sides of said panel pointing outward.

5. A shoring device as set forth in claim 1, wherein said vertical struts are rigidly and oppositely fastened onto each other via bolts or pins without intermediation of said horizontal strut.

6. A shoring device for trenches and ditches comprising:

panel means, for supporting walls of the excavations, having laterally on either end a guide means built onto and along the area denoting the thickness of said panel;

strutting assembly means, for supporting said panels means using vertical struts provided with panel guide means formed therein to engage partially and cooperate with said guide of said panel means, for sliding interlockingly relative to said panel, each said vertical strut means, being fastened rigidly on either end of at least one horizontal strut means, unable to pivot nor displace vertically along said vertical strut.

7. A shoring device for trenches and ditches comprising:

panel means, for supporting walls of the excavation having lengthwise two cutting edges built respectively on the top and at the bottom of said panel, each said cutting edge having a cross section outlining a right triangle, said cutting edges being arranged oppositely to each other by mean that said cutting edges are positioned on opposite sides of said panel pointing outward horizontal strut means, for supporting said panel using fastener to connect onto said panel.

* * * * *